US005520304A

United States Patent [19]

Lin

[11] Patent Number: 5,520,304

[45] Date of Patent: May 28, 1996

[54] BEVERAGE CONTAINER WITH EXTENDABLE DRINKING STRAW

[75] Inventor: Bang H. Lin, Taipei, Taiwan

[73] Assignee: Shing Hong Industrial Co., Ltd., Taiwan

[21] Appl. No.: 458,116

[22] Filed: Jun. 2, 1995

Related U.S. Application Data

[62] Division of Ser. No. 231,693, Apr. 25, 1994.

[51] Int. Cl.[6] ..... A47G 19/22; B65D 23/00

[52] U.S. Cl. ..... 220/707; 220/709; 215/229; 215/388

[58] Field of Search ..... 220/705, 707, 220/708, 709, 710; 215/1 A, 229; 229/75

[56] References Cited

U.S. PATENT DOCUMENTS

| | | | |
|---|---|---|---|
| 4,607,755 | 8/1986 | Andreozzi | 220/705 |
| 4,852,762 | 8/1989 | Chou-Sheng . | |
| 5,085,335 | 2/1992 | Carbaugh . | |
| 5,150,815 | 9/1992 | Saklad . | |
| 5,265,757 | 11/1993 | Wu . | |
| 5,273,172 | 12/1993 | Rossbach et al. . | |
| 5,337,918 | 8/1994 | Wang . | |
| 5,339,982 | 8/1994 | Tardie . | |
| 5,346,081 | 9/1994 | Lin . | |
| 5,361,934 | 11/1994 | Spence . | |

FOREIGN PATENT DOCUMENTS

| | | |
|---|---|---|
| 54562 | 6/1990 | Taiwan . |

*Primary Examiner*—Joseph M. Moy
*Attorney, Agent, or Firm*—Beveridge, DeGrandi, Weilacher & Young

[57] ABSTRACT

A beverage container is equipped with a rotatable cover and an automatically extendable drinking straw. The container includes an open ended body closed by a removable cap, a straw unit inserted through a conduit on the cap, a cover member rotatably fitted on the cap for rotational movement relative to the cap between a first position allowing the straw to extend through a slot of the cover member and a second position folding the straw unit and closing the slot. A groove formed on the cap engages a raised spot formed on the inner edge of the cover member for indicating when the cover member is rotated to either the first or second position. The straw unit includes a first straw made of elastomeric material and a second straw made of rigid material and sized so that the first straw is held between the conduit and the second straw in a coaxial relation without the use of fastening elements.

10 Claims, 6 Drawing Sheets

BEVERAGE CONTAINER WITH EXTENDABLE DRINKING STRAW

This application is a divisional of co-pending U.S. patent application Ser. No. 08/231,693 filed on Apr. 25, 1994, which application is entirely incorporated herein by reference.

The present invention relates to a beverage container with a rotatable cover and an automatically extendable drinking straw.

BACKGROUND OF THE INVENTION

Conventional beverage containers require the cap to be first opened and then the beverage in the container to be poured into the container cap or a cup for drinking. This procedure is easy for an adult or a big child, but small children do not find it easy and often spill the beverage during drinking.

To solve the above problem, a beverage container with an automatically extendable straw as shown in FIGS. 1 and 2 was developed. This beverage container 1 includes a body 11, a cap 12, upper and lower straws 13*a* and 13*b* and a cover 14. The body 11 is a hollow cylindrical member for containing the beverage such as juice, water, etc.

The cap is screwed onto an outer thread of an upper open end of the body 11. Upper and lower disk members 121, 122 are formed with an annular groove 123 and two symmetric cuts 124. The cap is formed with a tube 17 having a through hole to receive the straws 13*a* and 13*b* by means of which a user can suck the beverage from the container body. A strip 77 is used for fastening the upper straw 13*a* around the tube 17. Further, a member 125 is disposed on the upper member 121.

The cover 14 is disposed above the cap 12 and has an open end. Two symmetrically disposed projections 141 are formed on the inner edge of its open end corresponding to the cuts 124 in the cap 12. An upper wall of the cover 14 is formed with a slot 142 therein to receive the upper straw 13*a* which extends therethrough. A stopper 143 is formed on the inner surface of the upper wall in the vicinity of the slot 142.

When the projections 141 on the cover 14 are aligned with the cuts 124 on the cap 12, the cover 14 fits on the cap 12. The cover 14 can be rotated counterclockwise to move the slot 142 to a position above the straw 13 which extends outwardly through the slot 142 by means of its own resilience, so as to make the straw 13 available for a user to suck the beverage from the body 11. Conversely, when the cover 14 is rotated clockwise, the upper straw 13*a* is bent by the upper wall of the cover 14 and withdraws back into it. The rotation of the cover 14 is stopped when the stopper 143 abuts against the member 125 which is then just below the slot 142 to prevent foreign objects from entering into the cover 14.

One drawback of such known container is that the member 125 having a planer surface fails to effectively shield the slot 142 formed on the slightly arcuate upper wall of the cover member 14. Consequently, dust or other contaminants may pass through the clearance between the slot 142 and the member 125 to contaminate the upper straw 13*a*.

It is also difficult for a user to recognize when the cover 14 has been rotated to a position where the upper straw 13*a* extends through the slot 142 and to a position where the upper straw 13*a* has been well folded and the slot of the cover member has been well shielded.

Furthermore, the use of the elongate fastening strip 77 to secure the upper straw 13*a* onto the tube 17 is time consuming in assembly. The strip 77 secured around the straw is likely to be cut off or taken off or even swallowed by a child user to cause injury to the child. In addition, the strip 77 has a bulged end which is likely to scrape or hurt the child.

SUMMARY OF THE INVENTION

It is a primary object of the present invention to provide an improved beverage container with an automatically extendable straw unit of a novel structure such that when the straw is in its folded condition, the slot on the cover is effectively closed. Moreover, a user can easily recognize when the cover is rotated to either a position closing a slot on the cover or a position extending the straw outwardly.

There is thus provided a beverage container according to the invention comprising an open ended body closed by a removable cap, straw unit means extending through the cap, a cover member rotatably fitted on the cap for rotational movement relative to the cap between a first position allowing the straw to extend through a slot of the cover member and a second position folding the straw and closing the slot. A means for closing the slot is provided to prevent contaminants from passing through the slot when the cover is rotated to the second position, and means for signaling when the cover is rotated to the first or second position is provided.

It is a further object of the present invention to provide an improved combination of a cap and a straw unit for a beverage container, which simplifies the structure and enhances safety during use.

There is thus provided according to the present invention a combination of a cap and a straw unit for a beverage container. The cap has a cylindrical conduit opening at both ends and communicating with the internal volume of the container. The straw unit includes a first straw made of elastomeric material and a second straw made of rigid material and sized so that the first straw is held between the conduit and the second straw in a coaxial relation without the use of fastening elements.

The present invention can be best understood through the following description and accompanying drawings, wherein:

DETAILED DESCRIPTION OF THE PREFERRED EMBODIMENTS

Figure 1:
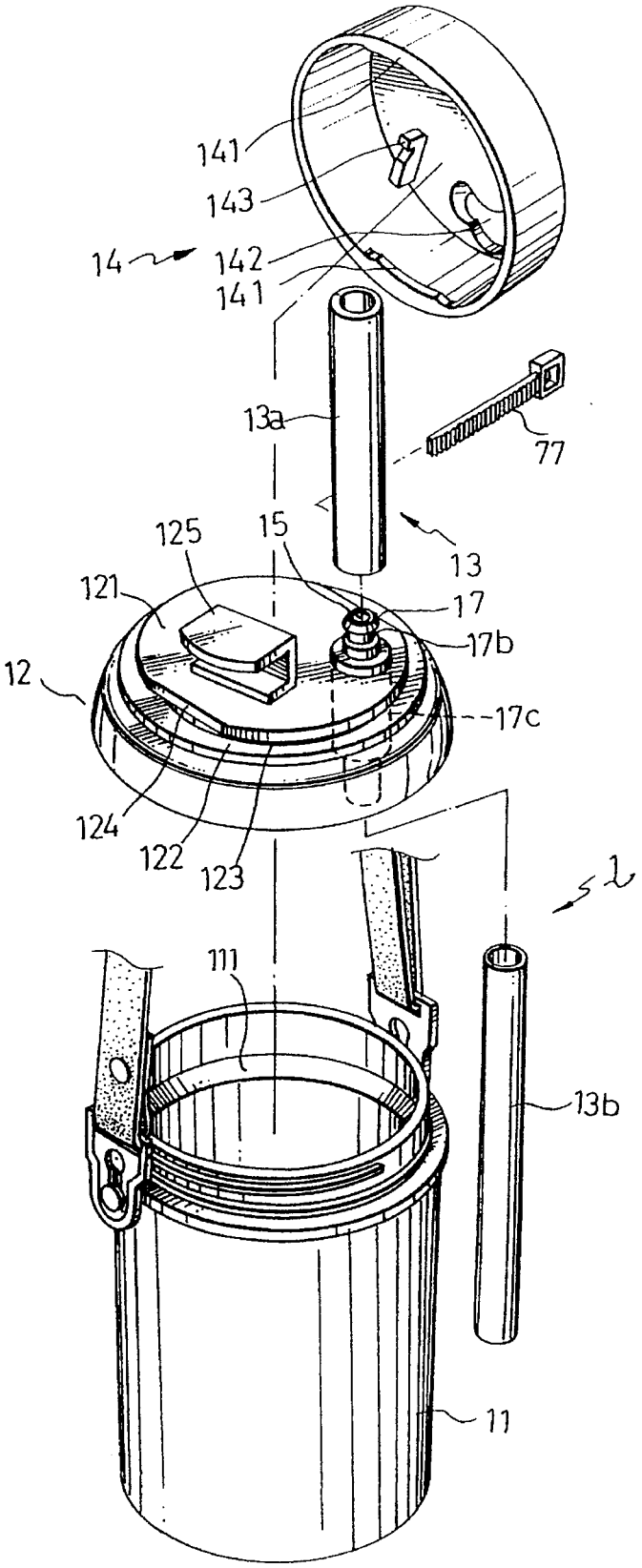
FIG. 1 PRIOR ART
FIG. 1 is a perspective exploded view of a prior art container.
Figure 2:
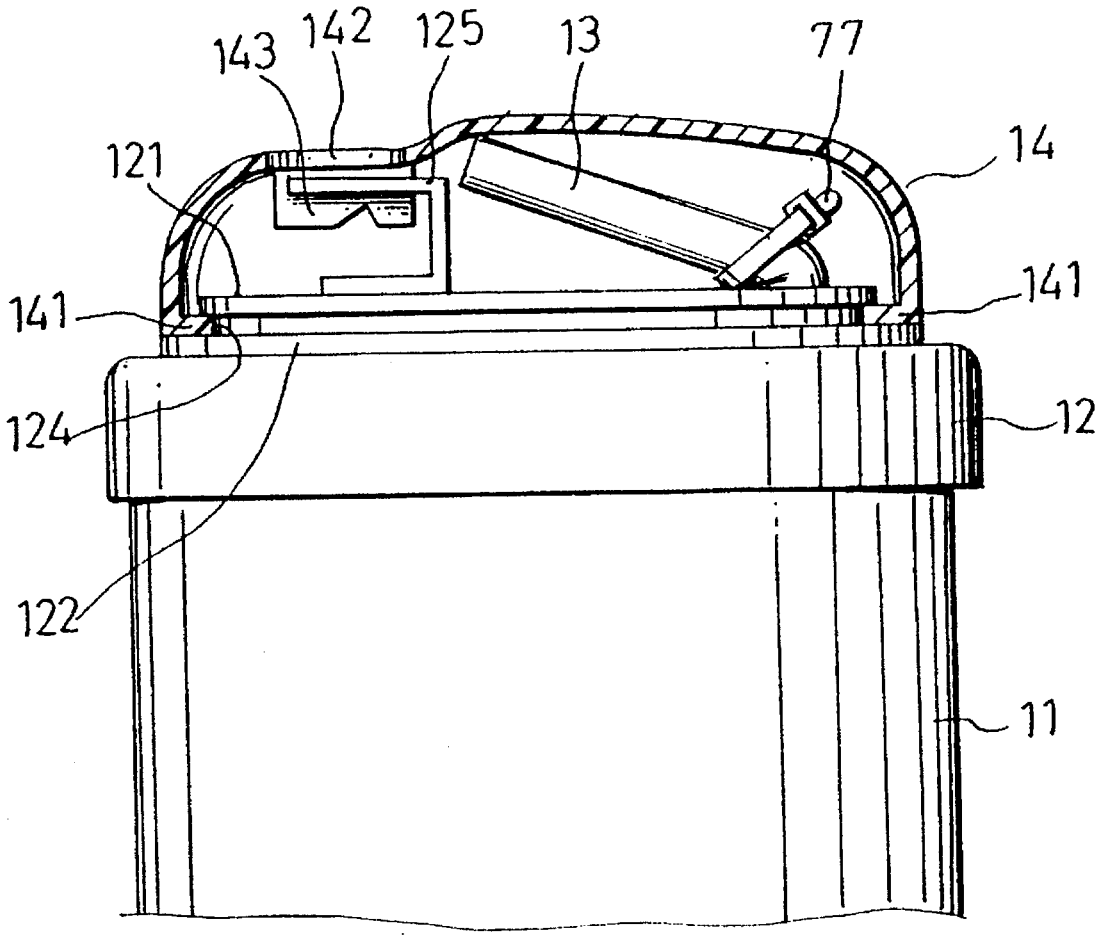
FIG. 2 PRIOR ART
FIG. 2 is a perspective assembled view of the container shown in FIG. 1.
Figure 3:
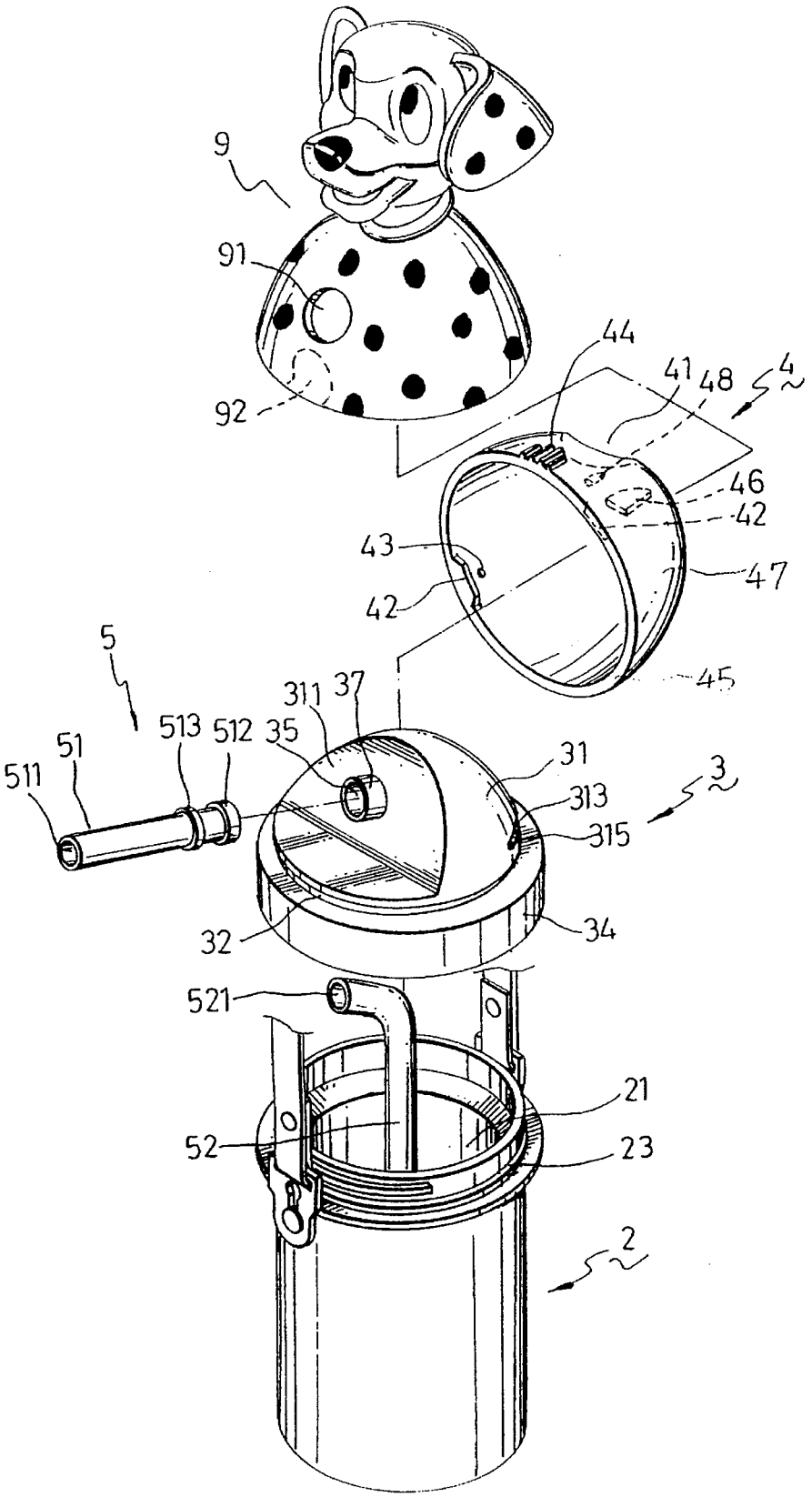
FIG. 3 is a perspective exploded view of a preferred embodiment of a container of the present invention.
Figure 6:
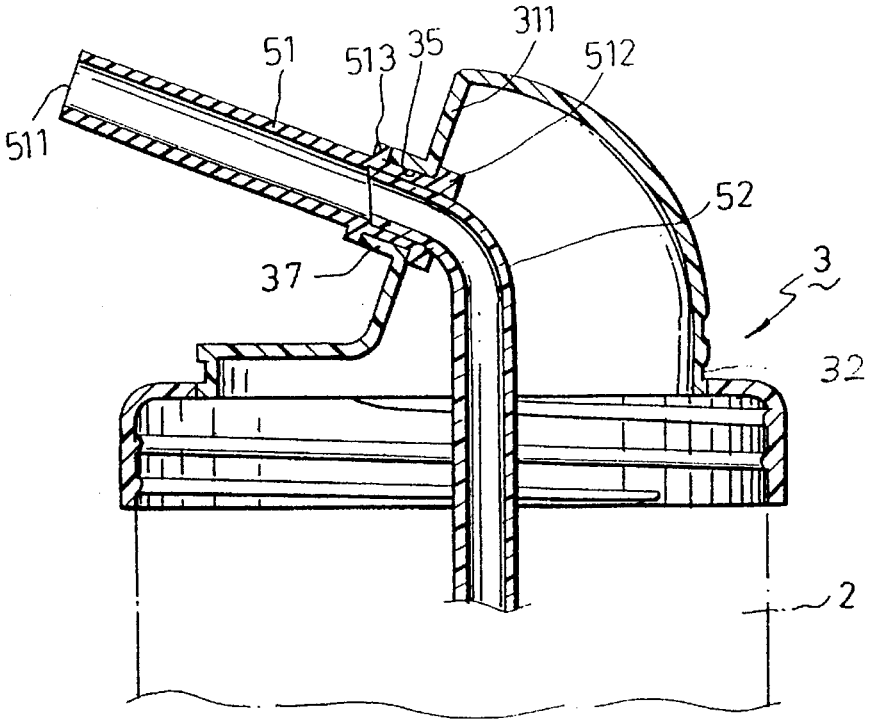
FIG. 6 is a cross-sectional view, showing the arrangement of a straw unit and a cap of the container of FIG. 3.

Referring to FIGS. 3 and 6, a container of the present invention comprises a body 2 having an inner chamber 21 for receiving beverage and an upper open end with outer thread 23, a cap 3 screwed on the outer thread of the open end of the body 2, a cover member 4 rotatably disposed above the cap 3, a straw unit 5 extending through the cap 3, and a decorative cover 9 fixed on the cover member 4.

The cap 3 has a lower cylindrical portion 34 and an upper portion. The upper portion is defined by a convex curved portion 31 and a lateral inclined wall 311. In this manner the upper portion is shaped like a quarter of a sphere. A circumferential groove 32 is formed extending around the entire surface of the curved portion 31, at its lower edge. Above the groove 32, a groove 313 with two ends is formed, extending partially around the surface of the portion 31 and parallel to the groove 32. Two raised bead 315, 315' are provided on the groove 313 in the vicinity of the two ends of the groove 313.

The wall 311 of the cap 3 has a length of a cylindrical conduit 37 opening at both ends and communicating with the internal volume of the container body 2. The conduit 37 is projected from the wall 311 and directed toward a slot 41 formed on the cover 4. It is not necessary that the conduit 31 projects outwardly as shown. For example, it may project from the wall 311 toward the interior of the cap 3 (not shown).

The straw unit 5 comprises an upper straw 51 extending out from the conduit 37 and a lower straw 52 connected with the upper straw 51 and located between the cap 3 and the container body 2. The upper straw 51 is made of elastomeric material such as silicon rubber and has an outer diameter slightly less than the inner diameter of the conduit 37. The upper straw 51 has two spaced outward flanges 512, 513, with the flange 513 at one end abutting against the free end of the conduit 37 and the flange 512 abutting against the inner surface of the wall 311. Although the flanges 512, 513 as illustrated have the same outer diameter, the outer diameter of the flange 512 may be greater than that of the flange 513 such that the flange 513 may pass through the conduit 37 due to its elasticity while the flange 512 can not.

The lower straw 52 is made of rigid material such as polyester (PE) material and has an outer diameter slightly greater than the inner diameter of the upper straw 51, but less than the inner diameter of the conduit 37. The lower straw 52 has a tapered end 521 for easy insertion into the upper straw 51. Thus, when the lower straw 52 is inserted into the upper straw 51 which already is inserted through the conduit 37, the upper straw 51 is expanded to contact the inner surface of the conduit 37. The upper straw 51 is therefore connected with the lower straw 52 and held in position due to frictional force in a coaxial relation, with its outer surface in surface contact with the inner surface of the conduit 37 and its inner surface in surface contact with the outer surface of the lower straw 52. The surface contacts form seals, preventing the flow of beverage therebetween.

The cover member 4 is disposed above the cap 3 and has an upper dome-typed wall 47 and an open end 45. The dome-typed wall 47 of the cover member 4 is formed with a slot 41 for the upper straw 51 to extend outwardly therethrough for a user to use. Two symmetrically disposed projections 42 are formed on the inner edge of its open end for slidably engaging the groove 32 on the curved portion 31 of the cap 3, allowing the cover member 4 to be rotated relative to the cap 3 as known.

The wall 47 of the cover member 4 is so sized that the inner surface of the wall 47 slidably engages the outer surface of the curved portion 31 of the cap 3, such that the slot 41 of the cover member 4 can be tightly closed by the curved portion 31 of the cap 3 to keep the straw 51 from being contaminated when the container is not used. Preferably, the inner surface of the dome-typed wall 47 and the outer surface of the curved portion 31 have the same curvature. As shown in FIGS. 4B and 5, the upper straw 51 is folded and stored in a space defined by the wall 311 of the cap 3 and the inner surface of the cover member 4, while the slot 41 of the cover 4 is tightly closed by the curved portion 31 of the cap 3.

A projecting plate 46 is formed on the inner surface of the curved wall of the cover 4 above one of the projections 42 and near the slot 41. Between the plate 46 and the slot 41, a projecting stopper 48 is provided. Above another projection 42, a raised spot 43 is formed on the inner surface of the cover 4 approximately opposing the plate 46 for slidably engaging the groove 313 on the curved portion 31 of the cap 3.

Figure 4A:
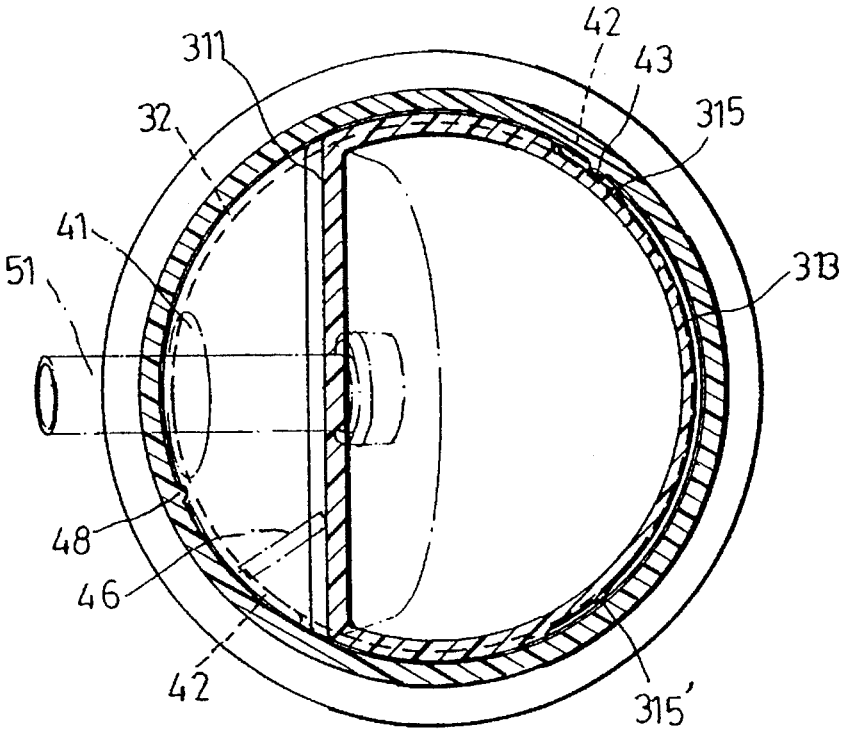
FIG. 4A is a cross-sectional view taken along line 4—4 in FIG. 5, showing a straw of the container of the invention in a position ready for use.
Figure 4B:
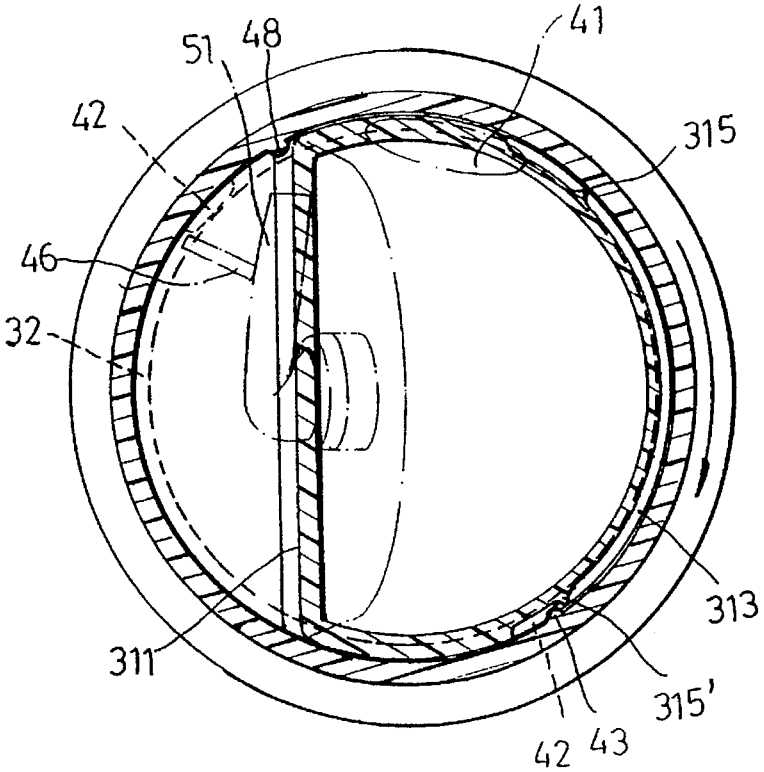
FIG. 4B is a cross-sectional view taken along line 4—4 in FIG. 5, showing a straw of the container of the invention in a folded, blocked position.
Figure 5:
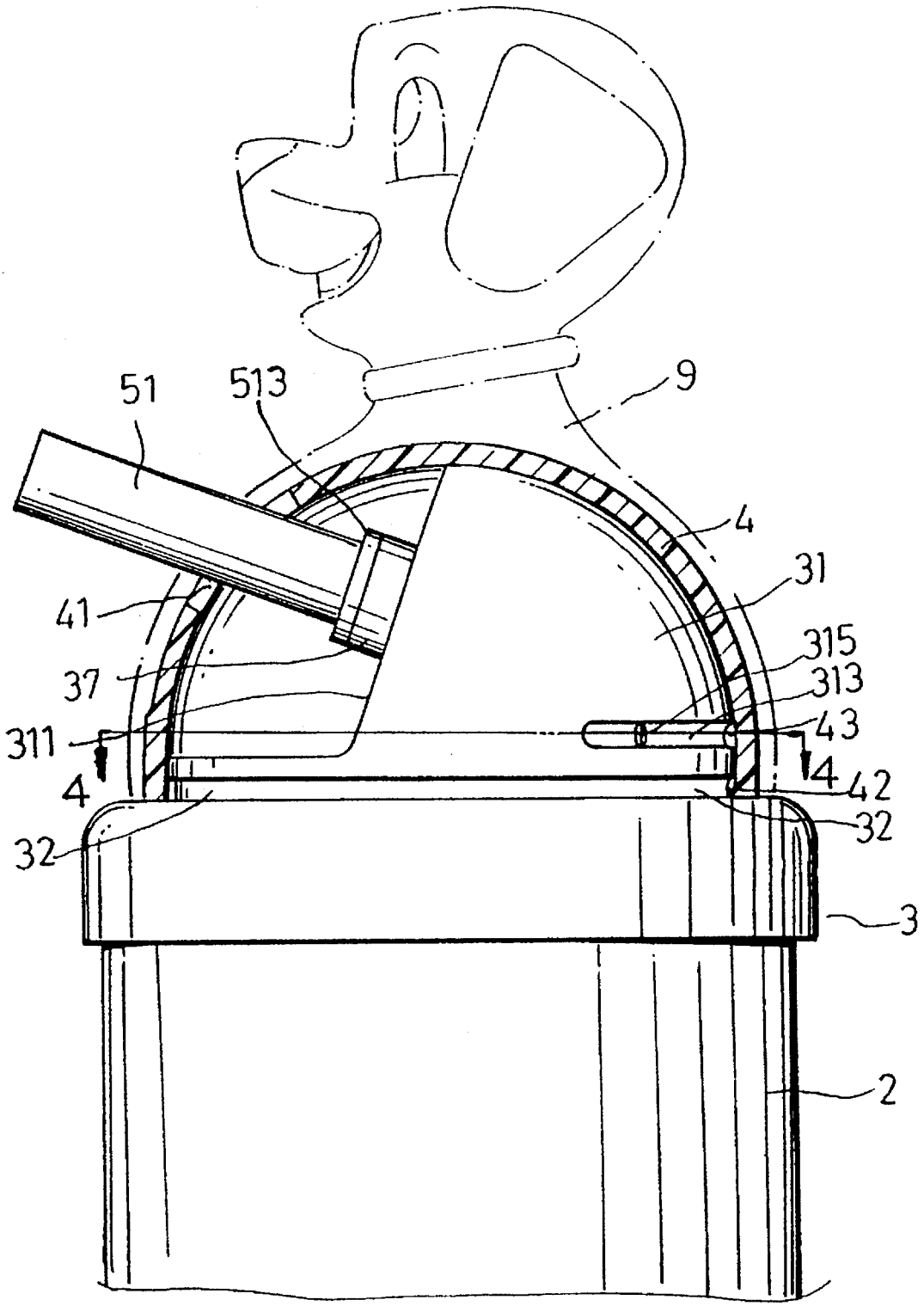
FIG. 5 is a partial cross-sectional view of the container of FIG. 3, showing a straw extending outside a cover member.

Thus, the cover 14 can be rotated counterclockwise to move the slot 41 from a folded position as shown in FIG. 4B to a position facing the upper straw 51 and permitting the upper straw 51 to extend outwardly therethrough (as shown in FIG. 4A), to thereby provide the upper straw 51 to enable a user to suck the beverage from the container body 2. When the slot 41 arrives at the position shown in FIG. 4A, the spot 43 on the cover 4 moves over the raised bead 315 and a pop sound is generated due to the deformation and recover of the cover 4, signaling a user that the cover 4 has been well located. The projecting plate 46 concurrently abuts against an edge of the inclined wall 311 to stop further rotation of the cover 4, as shown in FIG. 4A. Meanwhile, the spot 43 is positioned on the groove 313 between the bead 315 and one end of the groove 313.

Conversely, when the cover 4 is rotated clockwise from the position shown in FIG. 4A to a position shown in FIG. 4B, upon the upper straw 51 being bent by the plate 46 of the cover 4 against the inclined wall 311, the spot 43 moves over the bead 315' and a pop sound is generated, signaling the user that the cover 4 has been well located to fold the straw 51 and that the slot 41 on the cover 4 has been tightly closed by the curved portion 31 of the cap 3. Meanwhile, further clockwise rotation of the cover 4 relative to the cap 3 is prevented by the stopper 48 which is abutting against an edge of the inclined wall 311, as shown in FIG. 4B. The spot 43 now is located on the groove 313 between the bead 315' and the other end of the groove 313.

A decorative cover 9 designed with an attractive pattern may be fixed above the cover 4 as shown in FIGS. 3 and 5. The decorative cover 9 is formed with a through hole 91 corresponding to the slot 41 of the cover 4 for the upper straw 51 to extend therethrough. The cover 4 is formed with a projecting section 44 engaging a corresponding recess 92 formed on the decorative cover 9 such that the cover 4 can be rotated by rotating the decorative cover 9.

Figure 7:
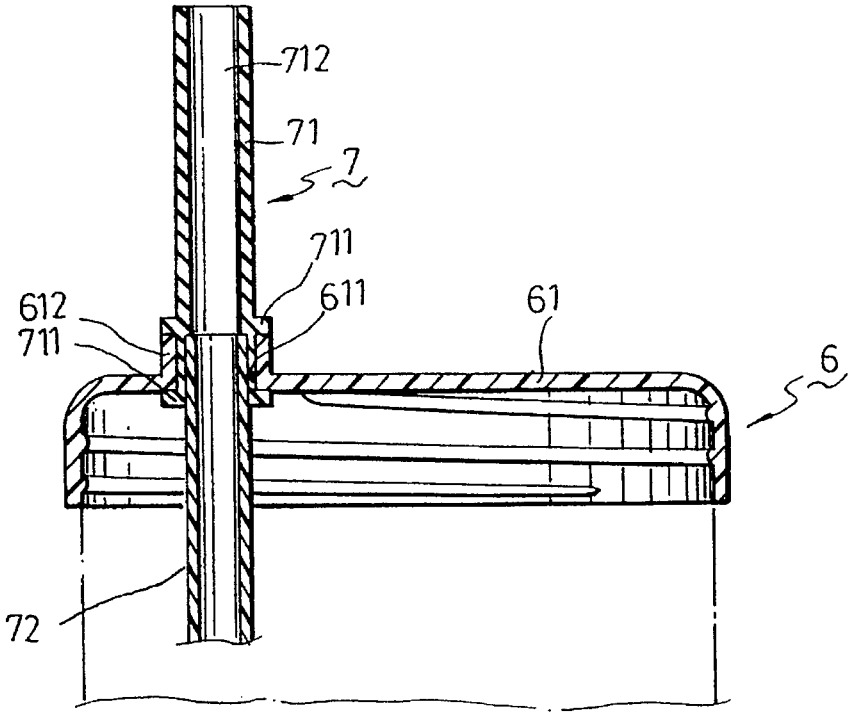
FIG. 7 is a cross-sectional view, showing an alternative embodiment of the arrangement of the straw unit and cap.

FIG. 7 shows an alternative embodiment of a combination of a straw unit and a cap of a beverage container of the present invention wherein the upper straw extends through a horizontal portion of the cap, rather than through an inclined wall as shown in FIG. 6.

A cap 6 as shown in FIG. 7 has a horizontal wall 61 which has a vertical cylindrical conduit 612 opening at both ends and communicating with the internal volume of a container body (not shown). A straw unit 7 comprises an upper straw 71 extending out the conduit 612 and a lower straw 72 connected with the upper straw 71. The upper straw 71 and lower straw 72 are made of the same materials as those of the upper straw 51 and lower straw 52, respectively, of the embodiment of FIG. 6.

Similar to the arrangement shown in FIG. 6, the upper straw 71, lower straw 72 and the conduit 612 are sized so that the upper straw 71 is connected with the lower straw 72 and held in position in a coaxial relation, with its outer surface in surface contact with the inner surface of the conduit 612 and its inner surface in surface contact with the outer surface of the lower straw 72. The surface contacts form seals, preventing the flow of beverage in the container body therebetween.

It should be noted that the above embodiments are only examples of the present invention and any modification or derivation thereof should fall within the scope of the present invention.

I claim:

1. A combination of a cap and a straw unit for a beverage container closed by the cap, the cap having an upper wall and a cylindrical conduit projecting from the upper wall, the conduit opening at both ends and communicating with an internal volume of the container, wherein the straw unit is inserted through the conduit and includes a first straw made of elastomeric material and a second straw made of rigid material, wherein the first and second straws are sized so that the first straw is held between the conduit and the second straw in a coaxial relation without the use of fastening elements.

2. The combination as claimed in claim 1, wherein the first straw has an inner diameter slightly less than an outer diameter of the second straw, the first straw having at least one outward flange at a first end thereof.

3. The combination as claimed in claim 2, wherein the conduit projects from an inclined portion of the upper wall of the cap.

4. The combination as claimed in claim 2, wherein the conduit projects from a horizontal portion of the cap.

5. A combination comprising:

a cap, wherein the cap includes an upper wall, and an open cylindrical conduit is defined in the upper wall; and a straw unit attached to the cap, wherein the straw unit includes a first straw member made of an elastomeric material and a second straw member made of a rigid material, wherein the first straw member extends through the conduit of the cap and is held between a wall of the conduit and the second straw member in a coaxial relation without using fastening elements.

6. The combination as claimed in claim 5, wherein the first straw member has an inner diameter slightly less than an outer diameter of the second straw member, the first straw member having at least one outwardly extending flange at a first end thereof.

7. The combination as claimed in claim 6, wherein the conduit projects from an inclined portion of the upper wall of the cap.

8. The combination as claimed in claim 6, wherein the conduit projects from a horizontal portion of the cap.

9. The combination as claimed in claim 5, wherein the conduit projects from an inclined portion of the upper wall of the cap.

10. The combination as claimed in claim 5, wherein the conduit projects from a horizontal portion of the cap.

* * * * *